US007182593B2

(12) United States Patent
Lin

(10) Patent No.: US 7,182,593 B2
(45) Date of Patent: Feb. 27, 2007

(54) CANDLE MAKING PROCESS

(75) Inventor: Vincent Lin, Englewood Cliffs, NJ (US)

(73) Assignee: Silk Road Gifts, Inc., Carlstadt, NJ (US)

( * ) Notice: Subject to any disclaimer, the term of this patent is extended or adjusted under 35 U.S.C. 154(b) by 0 days.

(21) Appl. No.: 10/822,422

(22) Filed: Apr. 12, 2004

(65) Prior Publication Data

US 2005/0227193 A1 Oct. 13, 2005

(51) Int. Cl.
*F23D 3/16* (2006.01)
*F23D 3/18* (2006.01)
*F23Q 2/32* (2006.01)

(52) U.S. Cl. ..... 431/291; 431/126; 431/325; 431/289

(58) Field of Classification Search ..... 431/291, 431/289, 288, 126, 325; 362/161, 166, 173, 362/178; 264/271; 206/575, 457, 573, 38
See application file for complete search history.

(56) References Cited

U.S. PATENT DOCUMENTS 6,033,210 A * 3/2000 Freeman ..... 431/291
6,129,771 A * 10/2000 Ficke et al. ..... 44/275
6,171,102 B1 * 1/2001 Freeman et al. ..... 431/291
6,241,512 B1 * 6/2001 Freeman et al. ..... 431/291
6,491,517 B2 * 12/2002 Freeman et al. ..... 431/291
2002/0150854 A1 * 10/2002 Riches ..... 431/291

OTHER PUBLICATIONS

Paola Romanelli, Candle Crafts, 2001, Sterling Publishing Co., Inc., pp. 4-5 and 120-121.*
Designer Candles for all occasions, 1999, Yaley Enterprises, Inc., # 110612, p. 12.*
Suzanne McNeill, Embellished Candles Without Hot Wax, 1995, Design Originals, No. 4005, p. 9.*
Letty Oates, Naturally Creative Candles, 1999, Krause Publications, pp. 62-63.*

* cited by examiner

*Primary Examiner*—Cheryl Tyler
*Assistant Examiner*—Michael J. Early
(74) *Attorney, Agent, or Firm*—Foley & Lardner LLP

(57) ABSTRACT

A jar candle includes at least two decorative elements located adjacent the interior of the jar and positioned in a predetermined relationship with respect to one another. A manufacturing method for forming the jar candle includes proving a jar having an interior surface defining an interior region. A sleeve having a predetermined pattern is slid over the jar. The sleeve and jar are aligned and a decorative element is applied to the interior surface of the jar element in alignment with the pre-determined pattern on the sleeve. The jar is then filled with wax.

8 Claims, 4 Drawing Sheets

CANDLE MAKING PROCESS

CROSS-REFERENCE TO RELATED PATENT APPLICATIONS

None.

BACKGROUND OF THE INVENTION

The present invention relates generally to the field of candles and candle making. More specifically, the invention relates to ajar candle having decorative items embedded therein.

Candles made from paraffin or wax are well known and are manufactured and sold in a variety of shapes and styles. In one style the candle is a stand alone product formed from a wax material and having a wick extending there through. It is known to embed material into the candle by adding the material into a mold as the wax is being poured into the mold. As the wax hardens the material is embedded within the candle. The candle is then removed from the mold. Alternatively, material may be affixed to the outer surface of a candle after the hardened wax is removed from the mold. If the decorative material is formed from wax, the decorative material may be affixed to the outer surface of the candle by the application of heat. This method allows for the placement of decorative material to the outer surface of a candle.

Another type of candle that is sold is ajar candle. This type of candle includes a wax portion that is located and sold within ajar. The jar may of be any shape and it may be tinted or clear. Typically, jar candles may include decorative elements that are mixed with the candle wax. However, the position of the decorative elements are haphazard and not necessarily adjacent the jar. It would be desirable to locate decorative material on the outer surface of the wax portion so that the decorative material may be viewed through the jar. Further, it would be desirable to place the decorative material in a consistent pattern within the jar.

SUMMARY OF THE INVENTION

One embodiment of the invention relates to ajar candle having an interior surface and a candle located within the jar. At least two decorative elements are located adjacent the interior and positioned in a predetermined relationship with respect to one another.

In another embodiment, a method for forming ajar candle includes proving a jar having an interior surface defining an interior region. A sleeve having a pre-determined pattern is slid over the jar. The sleeve and jar are aligned and a decorative element is applied to the interior surface of the jar element in alignment with the pre-determined pattern on the sleeve. The jar is then filled with wax.

DETAILED DESCRIPTION OF THE PREFERRED EMBODIMENTS

Figure 1:
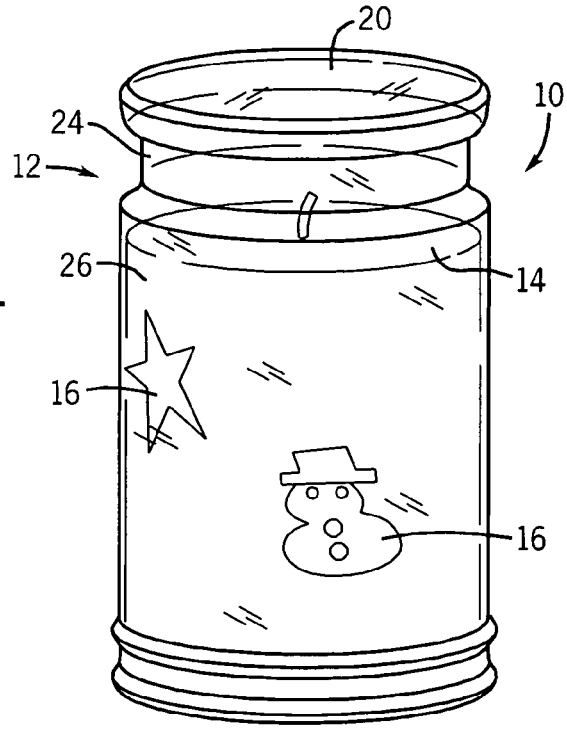
FIG. 1 illustrates ajar candle having decorative material embedded therein.
Figure 2:
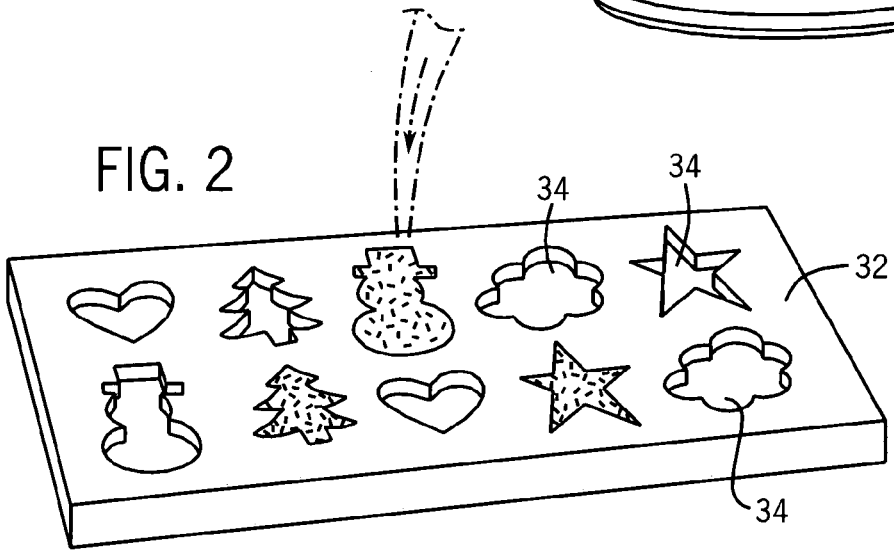
FIG. 2 illustrates a mold for forming decorative material.
Figure 3:
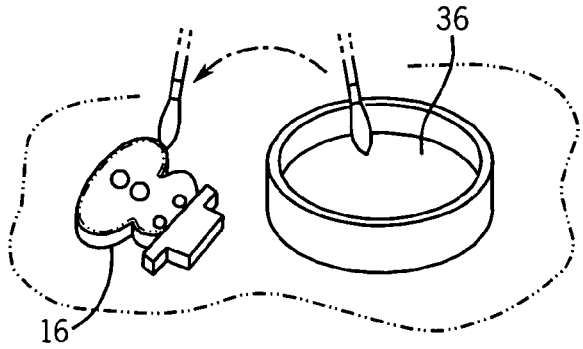
FIG. 3 illustrates the decorative material being painted.
Figure 4:
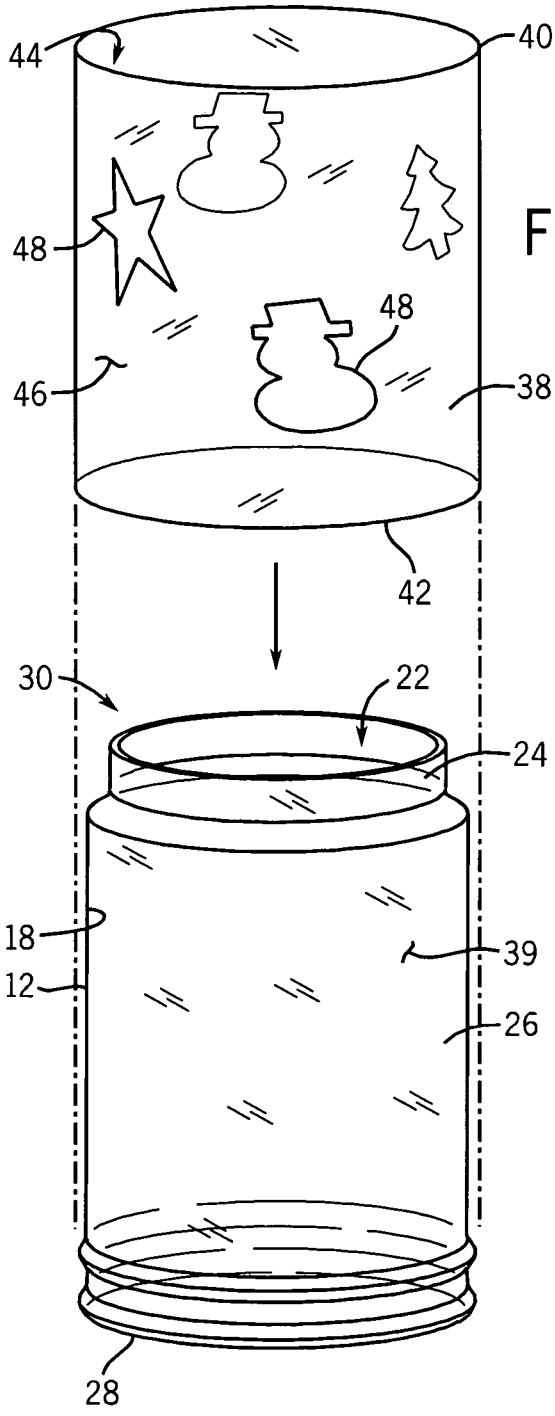
FIG. 4 illustrates a sleeve being placed over a jar.

Referring to FIG. 1, a jar candle 10 includes a jar 12 having a candle 14 located therein. Candle 14 includes a plurality of decorative elements 16 adjacent an inner surface 18 of jar 12. Decorative elements 16 maybe formed from a wax material such as paraffin, vegetable wax, beeswax or any other type of wax known in the art. Alternatively, decorative elements may be formed from natural or non-natural materials, such as wood, metal or any other type of material. The decorative elements 16 maybe placed in a predetermined relationship relative to one another and/or relative to jar 12. Jar 12 may also include a cover 20 that fits within an opening 22 of jar 12.

In a preferred embodiment, jar 12 includes a non-uniform profile that includes an upper portion 24 that has a cross section less than a cross section of a lower portion 26. Alternatively, jar 12 could include a profile in which the walls taper outward from a bottom 28 toward the top 30 of jar 12. Where the profile of the jar is not uniform, it is not possible to simply slide a pre-formed candle into the jar once the candle has hardened and have the candle be adjacent the entire inner surface of jar 12. Accordingly, in order for the pre-formed decorative elements 16 to be adjacent the inner surface of jar 12 for a non-uniform jar, the candle and elements need to be formed within the jar.

Referring to FIGS. 2–9, the process for manufacturing ajar candle with decorative elements 16 will now be described. In a preferred embodiment, decorative elements are formed from a wax material. A mold 32 includes at least one recess 34. A wax material is poured into recesses 34 of mold 32 and allowed to cool. Once the wax is cooled, a preformed decorative elements 16 are removed and decorated with paint 36 or other material such as glitter or any other material known in the art.

A clear sleeve 38 that has an open ended tubular shape is slid over an outer surface 39 of jar 12. Clear sleeve 38 includes an upper end 40 and a lower end 42. The inner surface 44 or an outer surface 46 of sleeve 38 includes a printed outline 48 of the decorative elements to be applied.

Jar 12 is placed on a support surface such as a table or work area and the bottom 42 of clear sleeve 38 is also supported on the support surface. In this manner clear sleeve 38 and jar 12 are vertically aligned. If jar 12 is non circular, it is possible to use a non-circular sleeve that has a shape corresponding to the non-circular jar. It is also possible to align clear sleeve 38 about the periphery of jar 12 in order to properly align the printed outline 48. For example, it may be desirable to align printed outline 48 with a label that may already be affixed to jar 12.

Figure 5:
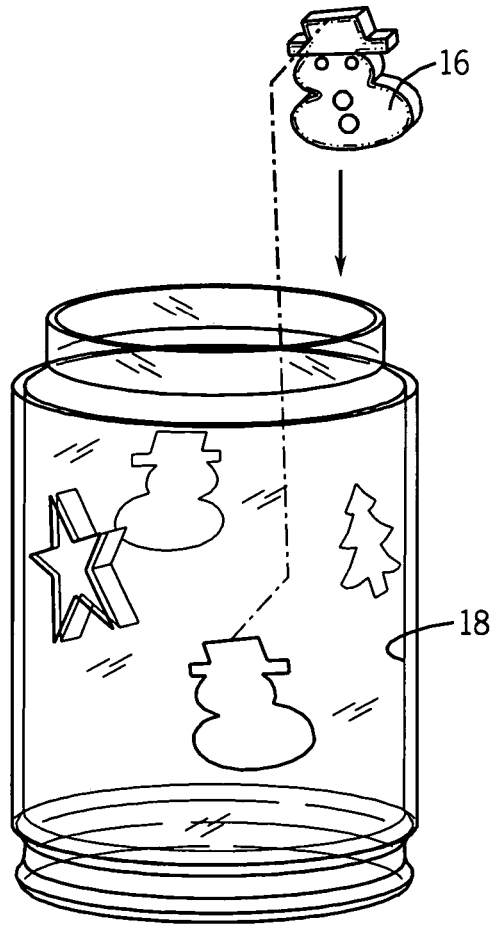
FIG. 5 illustrates a decorative element being located within the jar.

Referring to FIG. 5, decorative elements 16 are secured to the inner surface 18 of jar 12 at the location that aligns with the printed outline 48 of sleeve 38. Each element 16 may be secured to inner surface 18 with an adhesive 50 such as glue or the actual wax itself to form a temporary bond with the inner surface 18 of jar 12. In one embodiment, both jar 12 and sleeve 38 are clear so a user can easily align the decorative elements to fit within the printed outline 48 of sleeve 38. However, jar 12 and sleeve 36 may be tinted or otherwise not completely clear.

Figure 6:
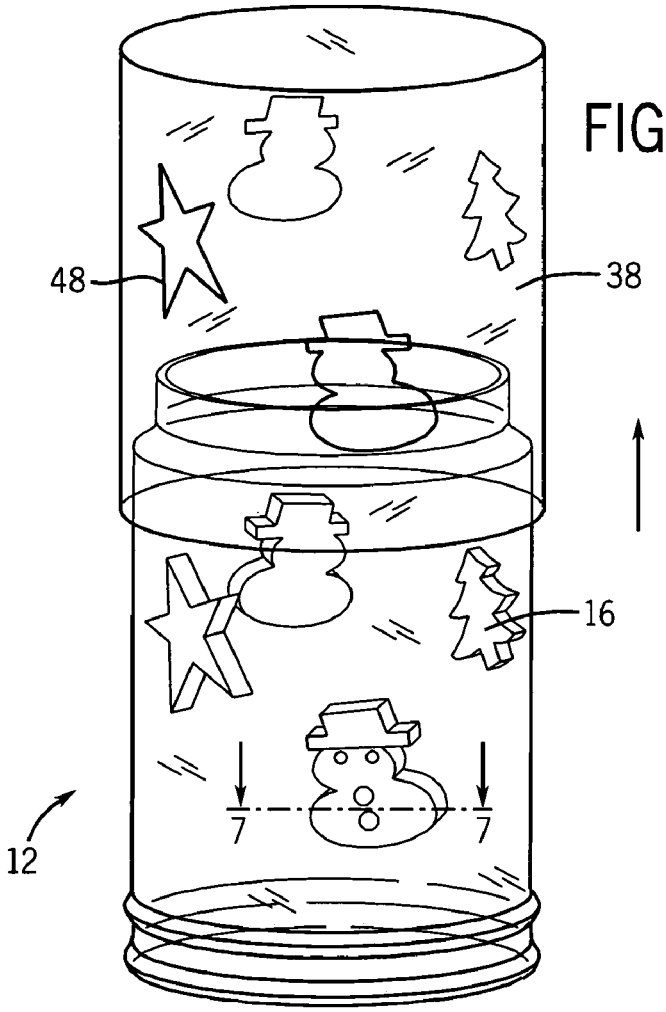
FIG. 6 illustrates the sleeve being removed from the jar.
Figure 7:
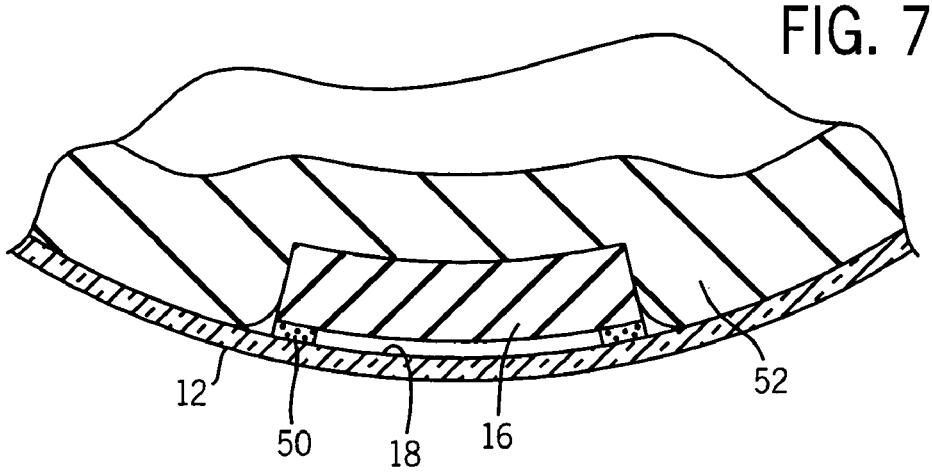
FIG. 7 illustrates a protective wax layer applied to the inside of the jar.
Figure 8:
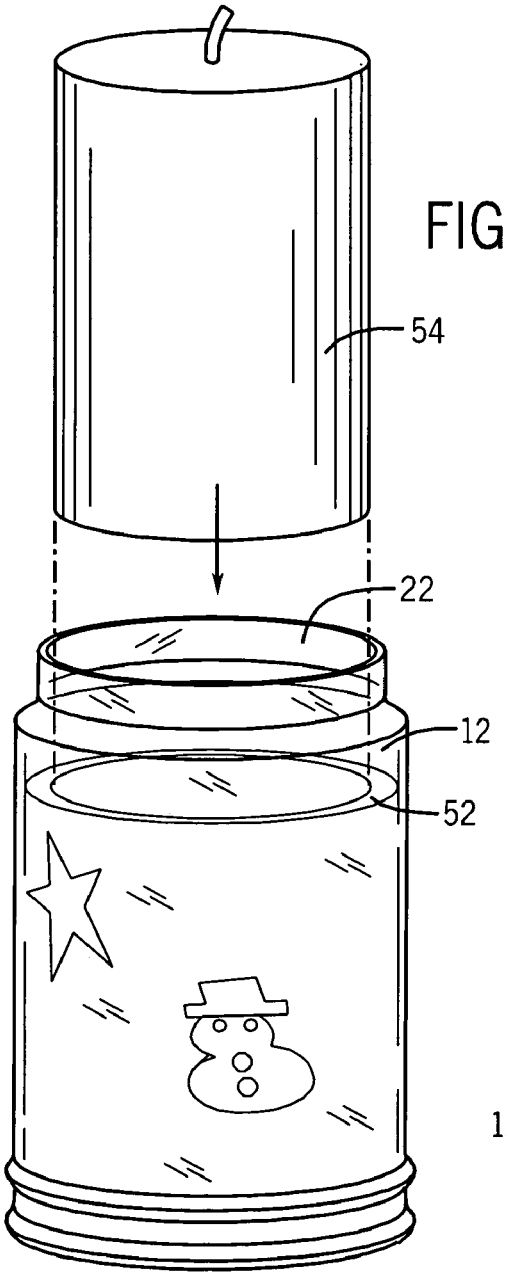
FIG. 8 illustrates a preformed candle insert being located within the jar.
Figure 9:
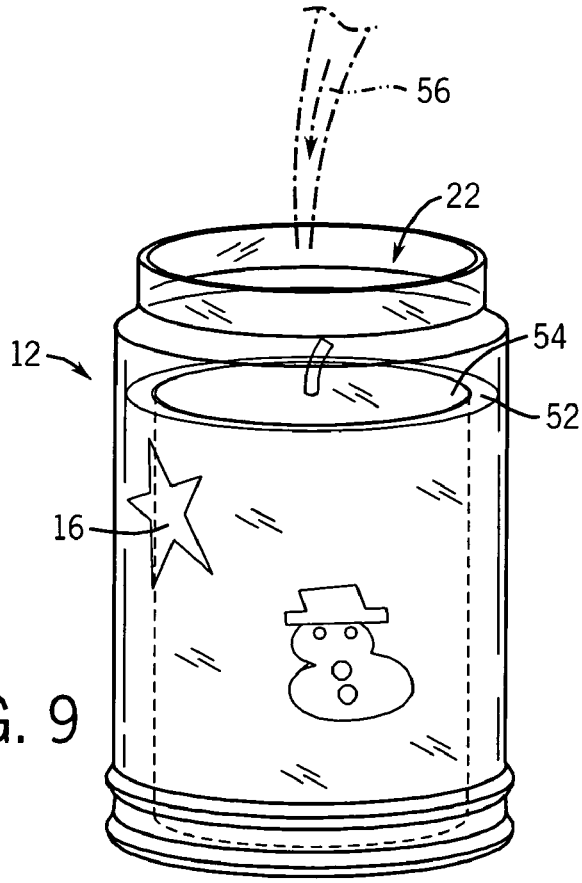
FIG. 9 illustrates a finishing wax being applied to the jar.

Referring to FIG. 6, once all of the decorative elements 16 are applied to the inner surface 18 of jar 12, sleeve 38 is slid off of jar 12. Sleeve 38 can then be used again for a second jar. In order to fully secure decorative elements within jar 12, a first wax 52 may be applied within jar 12. The application of first wax 52 may be accomplished by simply filling the interior of jar 12 to a level that covers the decorative elements. However, it may also be desirable to apply a first wax to only cover inner surface 18 of jar 12 and the decorative elements with a layer of wax, but not fill the entire jar. For example if the jar 12 has an inner diameter of 3 inches, the layer of first wax adjacent inner surface 18 may be 0.25 inches. This layer of wax can be poured in a melted state as the jar is being rotated about its longitudinal axis to evenly apply the first wax layer. If the decorative element is less than 0.25 inches an outer periphery and the face of the decorative element opposite a first side proximate the inner surface of the jar will be covered with the first layer of wax. It may be desirable that the first wax 52 have certain characteristics with regard to color, sheen or opacity that is not required of the entire candle.

Once, the first layer of wax 52 is applied, a second pre-formed candle 54 with a wick is inserted in the remaining opening that fits within opening 22 of jar 12. In one embodiment, the diameter of opening 22 is 2.5 inches, and pre-formed candle 54 has a diameter slightly less than the diameter of opening 22, to allow easy insertion of candle 54 within jar 12 and within the opening formed by first wax 52. It may be desirable to use a wax with coloring on the first wax layer and then eliminate the color in the second wax layer. Further, it may be desirable to have the first layer be translucent, so that the color of the second wax layer is seen though the first wax layer. The use of two layers or more of wax provides a cost effective approach to the manufacturing of the candle, thereby providing a less expensive product to the consumer.

A filler wax 56 is then poured into jar 12 to fully secured pre-formed candle 54 within jar 12. Filler wax 56 may be the same type of wax as first wax 52 thereby providing the appearance a uniform appearance of the wax within jar 12. The first, second and filler or finishing wax may be formed of any known wax material. In a preferred embodiment some of the wax may be a blend of palm oil and paraffin.

It is important to note that the construction and arrangement of the elements of the media as shown in the preferred and other exemplary embodiments is illustrative only. Although only a few embodiments of the present invention have been described in detail in this disclosure, those skilled in the art who review this disclosure will readily appreciate that many modifications are possible (e.g. variations in sizes, dimensions, structures, shapes and proportions of the various elements values of parameters, mounting arrangements, use of materials, orientations, etc.) without materially departing from the novel teachings and advantages of the subject matter recited in the claims. For example, the decorative elements may be placed via an electronic device such as a robot in a predetermined pattern, eliminating the need for the sleeve. Accordingly, all such modifications are intended to be included within the scope of the present invention as defined in the appended claims. Other substitutions, modifications, changes and omissions may be made in the design, operating conditions and arrangement of the preferred and other exemplary embodiments without departing from the spirit of the present invention as expressed in the appended claims.

What is claimed is:

1. A jar candle, comprising:

a jar having an interior surface;

a candle located within the jar;

at least two decorative elements being located adjacent the interior surface and positioned in a pattern;

the jar including an opening and a first portion having a first cross sectional area that is greater than a second cross-sectional area of a second portion, the second portion being located between the first portion and the opening;

the decorative elements including a first face being proximate the inner surface of the jar, the decorative element further includes a second face opposite the first face and an outer periphery extending between the first face and opposing second face, the outer periphery and second face of the decorative element being embedded within the candle;

the decorative elements being secured to the inner surface of the jar with an adhesive being a wax material;

a first wax material adjacent the inner surface of the jar and the decorative elements, the first wax material extending a pre-determined distance inward into an interior of the jar to form a first wax layer;

a second wax layer having a material different than the first wax layer and being located in an interior region defined by the first wax later; and a third layer of wax covering a top portion of the second wax layer.

2. A method for forming ajar candle, comprising:

providing a jar having an interior surface defining an interior region;

sliding a sleeve over the jar, the sleeve having a predetermined pattern;

aligning the sleeve and jar;

applying a decorative element to the interior surface of the jar, the decorative element being in alignment with the pattern on the sleeve; and covering the decorative element with wax;

wherein filling the jar with wax includes applying a first layer of wax adjacent the decorative elements and the interior surface of the jar and applying a second layer of wax within a cavity formed by the first layer of wax;

wherein applying a second layer of wax includes inserting a preformed candle having a second wax material and a wick within the cavity formed by the first layer of wax;

wherein the first layer of wax is a darker shade than the second layer of wax; and further including applying a finishing layer of wax to cover at least a portion of the second layer of wax.

3. The method of forming ajar candle of claim 2, further including forming a plurality of decorative elements from wax.

4. The method of forming ajar candle of claim 2, wherein providing a jar, includes providing a jar with an opening and a first portion having a first cross sectional area that is greater than a second cross-sectional area of a second portion, the second portion being located between the first portion and the opening.

5. The method of forming ajar candle of claim 2, wherein the pre-determined pattern on the sleeve includes an outline that matches an outer periphery of the decorative element.

6. The method of forming ajar candle of claim 5, wherein the first layer of wax is a lighter shade than the second layer of wax.

7. The method of forming a jar candle of claim 6, wherein the decorative elements are formed from wax and bleed into the first layer of wax.

8. The method of forming a jar candle of claim 2, wherein applying a decorative element includes applying at least two decorative elements in alignment with the pattern on the sleeve.

* * * * *

UNITED STATES PATENT AND TRADEMARK OFFICE

CERTIFICATE OF CORRECTION

PATENT NO. : 7,182,593 B2
APPLICATION NO. : 10/822422
DATED : February 27, 2007
INVENTOR(S) : Vincent Lin It is certified that error appears in the above-identified patent and that said Letters Patent is hereby corrected as shown below:

Column 4:
line 22, replace “ajar” with --a jar--.
line 44, replace “ajar” with --a jar--.
line 47, replace “ajar” with --a jar--.
line 53, replace “ajar” with --a jar--.
line 56, replace “ajar” with --a jar--.

Signed and Sealed this

Fifteenth Day of May, 2007

JON W. DUDAS
*Director of the United States Patent and Trademark Office*